US005887563A

United States Patent [19]

Shudo et al.

[11] Patent Number: 5,887,563

[45] Date of Patent: Mar. 30, 1999

[54] WORKING 4-CYCLE ENGINE

[75] Inventors: Shigeru Shudo; Shoji Kawase, both of Wako, Japan

[73] Assignee: Honda Giken Kogyo Kabushiki Kaisha, Tokyo, Japan

[21] Appl. No.: 822,152

[22] Filed: Mar. 17, 1997

[30] Foreign Application Priority Data

Mar. 19, 1996 [JP] Japan ..... 8-062571

[51] Int. Cl.[6] ..... F01M 1/00

[52] U.S. Cl. ..... 123/196 R; 123/196 W

[58] Field of Search ..... 123/196 R, 196 W

[56] References Cited

U.S. PATENT DOCUMENTS

| | | | |
|---|---|---|---|
| 4,206,739 | 6/1980 | Schrag | 123/196 R |
| 4,502,424 | 3/1985 | Katoh et al. | 123/196 R |
| 4,519,348 | 5/1985 | Hamilton | 123/196 R |
| 4,674,457 | 6/1987 | Berger et al. | 123/196 R |
| 4,798,254 | 1/1989 | Lings | 123/196 R |
| 4,825,825 | 5/1989 | Chino et al. | 123/196 W |

FOREIGN PATENT DOCUMENTS 7-87620 3/1995 Japan .

*Primary Examiner*—John T. Kwon

*Attorney, Agent, or Firm*—Nikaido Marmelstein Murray & Oram, LLP

[57] ABSTRACT

In a working 4-cycle engine including a crankcase, a cylinder block inclined with respect to the crankcase, and an oil pan located in a lower portion of the crankcase. An auxiliary oil tank is disposed below the cylinder block in the direction of inclination of the cylinder block. The auxiliary oil tank communicates with the inside of the oil pan and normally assumes a position higher than the level of oil stored in the oil pan. However, when the engine is tilted down in the direction of inclination of the cylinder block, the oil stored in the oil pan flows into and is accumulated in the auxiliary oil tank. Thus, even if the engine is tilted down in the direction of inclination of the cylinder block, the oil stored in the oil pan is prevented from flowing into the cylinder.

4 Claims, 4 Drawing Sheets

WORKING 4-CYCLE ENGINE

BACKGROUND OF THE INVENTION

1. Field of the Invention

The present invention relates to a working 4-cycle engine for use as a power source for a rammer, trimmer or the like, and particularly, to a working 4-cycle engine including a cylinder block which is connected to a crankcase having an oil pan in a lower portion thereof. The cylinder block is inclined sideways with respect to the crankcase.

2. Description of the Related Art

Conventionally, a 2-cycle engine which does not require an oil pan has been widely used as a working engine.

Even in the working engine, however, the employment of a 4-cycle engine is necessary from the viewpoint of purification of an exhaust gas. The present applicant has already proposed a 4-cycle engine of the above-described construction (see Japanese Patent Application No. 7-87620).

In the 4-cycle engine of the above-described construction, if this engine remains tilted for a long time in the direction of inclination of the cylinder block, there is a possibility that oil flowing from the oil pan into a cylinder in the cylinder block, may flow through the contact of a piston ring and cylinder block wall into a combustion chamber.

SUMMARY OF THE INVENTION

Accordingly, it is an object of the present invention to provide a 4-cycle engine of the above-described type wherein the possibility of oil flowing around a piston ring into a combustion chamber, is eliminated.

To achieve the above object, according to a first feature of the present invention, there is provided a working 4-cycle engine comprising a cylinder block which is connected to a crankcase having an oil pan in a lower portion thereof, the cylinder block being inclined sideways with respect to the crankcase, wherein the engine further includes an auxiliary oil tank which is disposed on one side of the cylinder block and is adapted to accommodate oil stored in the oil pan, when the engine is tilted down in the direction of inclination of the cylinder block.

With the first feature of the present invention, even if the engine is tilted down in the direction of inclination of the cylinder block, the oil is prevented from entering the cylinder in the cylinder block by transferring the oil stored in the oil pan into the auxiliary oil tank.

According to a second feature of the present invention, in addition to the first feature, the auxiliary oil tank is disposed below the cylinder block in the direction of inclination of the cylinder block, so that the interior of the auxiliary oil tank communicates with the interior of the oil pan through a communication pipe and with an upper portion of the interior of the crankcase through a vent pipe.

With the second feature of the present invention, the flow of oil out of the oil pan and into the auxiliary oil tank can be smoothly conducted depending upon the tilting-down and righting-up of the engine.

Further, according to a third feature of the present invention, in addition to the first or second features, a rod chamber, in which a tappet and a push rod of a valve operating device are accommodated, is defined in a lower sidewall in the cylinder block in the direction of inclination of the cylinder block.

With the third feature of the present invention, even if the rocker chamber is used as a return passage for the oil after being used to lubricate the valve operating mechanism, the oil in the oil pan can be prevented from entering the rocker chamber when the engine is tilted down with respect to the direction of inclination of the cylinder block.

The above and other objects, features and advantages of the invention will become apparent from the following description of the preferred embodiment taken in conjunction with the accompanying drawings.

DETAILED DESCRIPTION OF THE PREFERRED EMBODIMENTS

The present invention will now be described by way of an embodiment with reference to the accompanying drawings.

Figure 1:
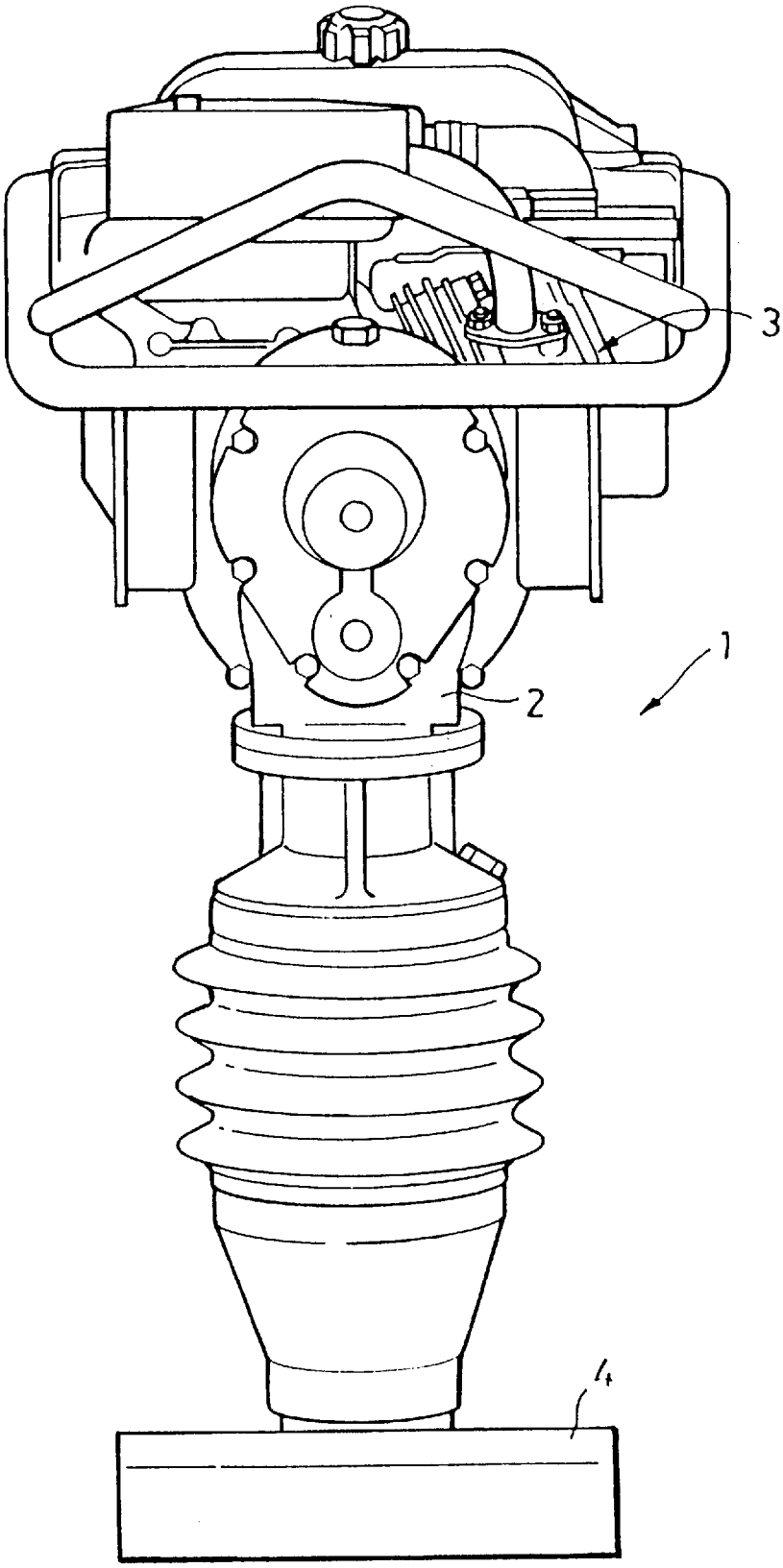
FIG. 1 is a front view of a rammer equipped with a 4-cycle engine according to the present invention.

Referring first to FIG. 1, a rammer 1 is constructed so that a 4-cycle engine 3 is mounted at an upper portion of a rammer body 2, and a leveling plate 4 is mounted at a lower portion of the rammer body 2. When the engine 3 is operating, a crank mechanism and a strut bar within the rammer body 2 are driven to vertically vibrate the leveling plate 4, thereby performing tamping of a roadbed.

Figure 2:
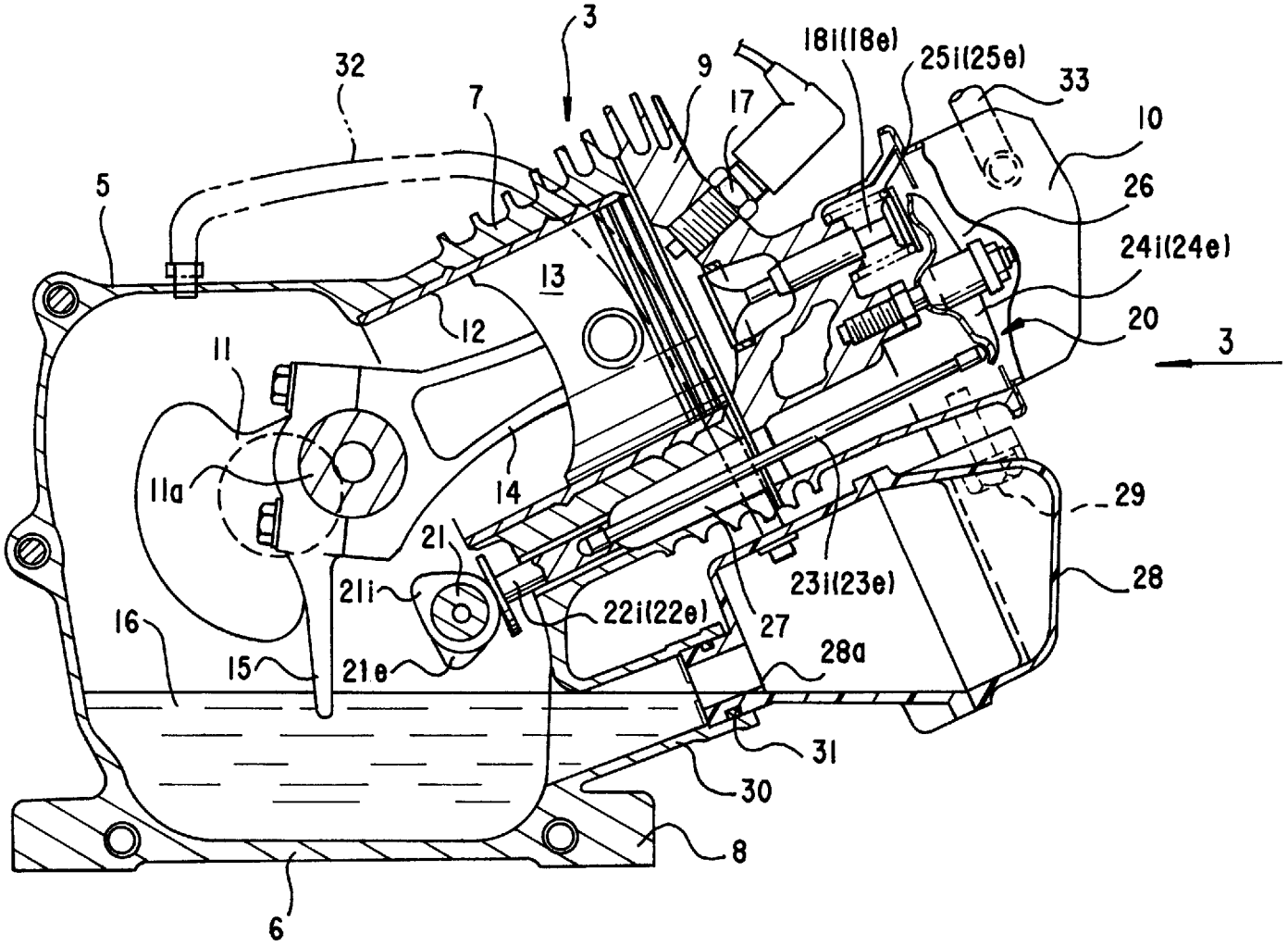
FIG. 2 is a vertical sectional front view of the engine.
Figure 3:
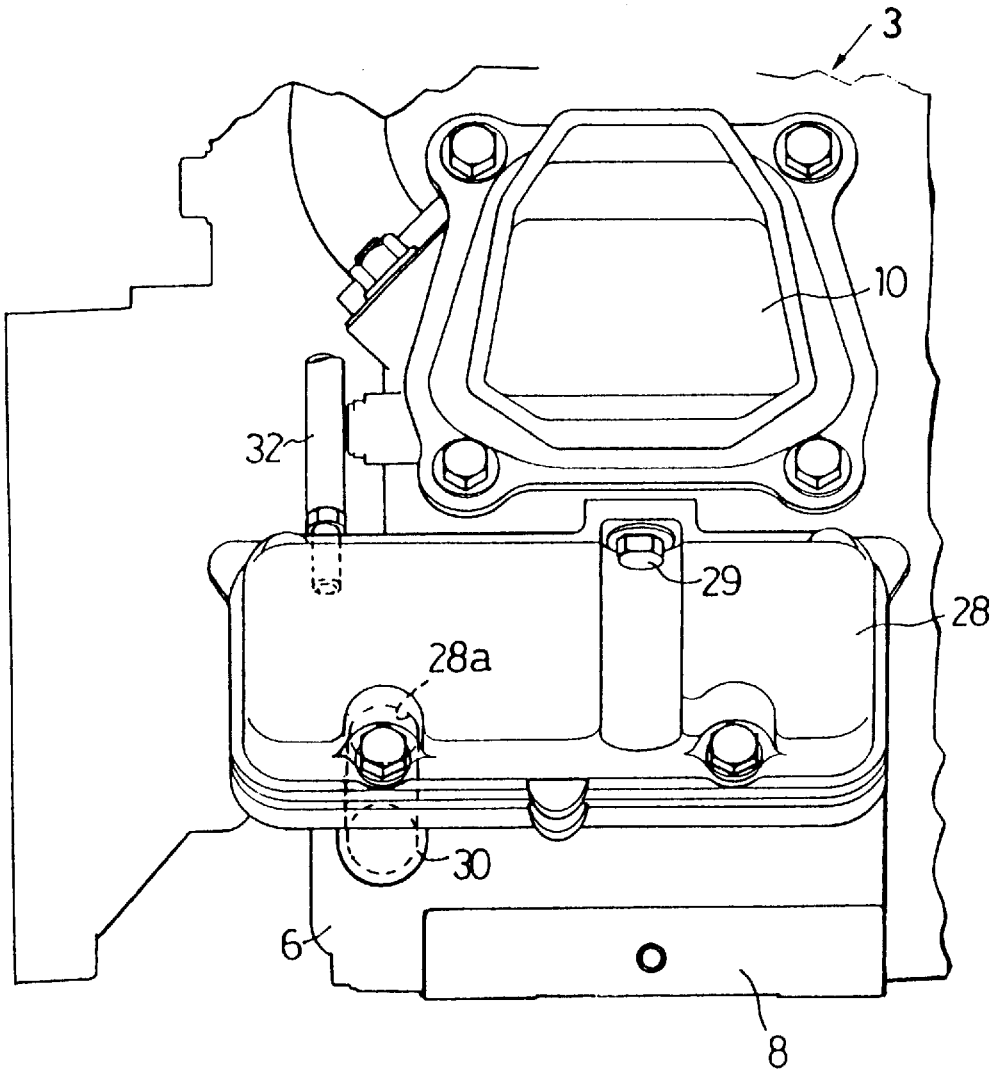
FIG. 3 is a view taken along line 3—3 in FIG. 2.

As shown in FIGS. 2 and 3, the 4-cycle engine 3 includes a crankcase 5 having a lower portion formed by an oil pan 6. A cylinder block 7 is integrally connected to an upper portion of the crankcase 5 and inclined sideways. An installation base 8 is integrally formed on the oil pan 6 to protrude from an outer periphery of the oil pan 6. A cylinder head 9 is fixed to an upper end of the cylinder block 7, and a head cover 10 is fixed to an upper end of the cylinder head 9.

A crankshaft 11 is horizontally supported in the crankcase 5, and the cylinder block 7 is disposed in a position inclined at substantially 60° from a vertical line through the axis of the crankshaft 11 in FIG. 2. Such an arrangement decreases the entire height of the engine 3 to a level lower than the maximum height.

A piston 13 disposed in a cylinder 12, incorporated by casting-in in the cylinder block 7, and a crank pin 11*a* of the crankshaft 11 are interconnected through a connecting rod 14. An oil dipper 15 is formed on a larger-diameter end of the connecting rod 14, so that oil 16 stored in the oil pan 6 is scattered during rotation of the crankshaft 11.

A spark plug 17 and intake and exhaust valves 18*i* and 18*e* are mounted in the cylinder head 9. A valve operating device 20 for opening and closing the intake and exhaust valves 18*i* and 18*e* is of a push rod/rocker arm type. More specifically, the valve operating device 20 comprises a cam shaft 21 supported in the crankcase 5 and driven in a reduced manner from the crankshaft 11 through a timing gear (not shown). Tappets 22*i* and 22*e* and push rods 23*i* and 23*e* are lifted and lowered by intake and exhaust cams 21*i* and 21*e* on the cam shaft 21, respectively, and rocker arms 24*i* and 24*e* interconnect the push rods 23*i* and 23*e* and the intake and exhaust valves 18*i* and 18*e*, respectively. Valve springs 25*i* and 25*e* bias the intake and exhaust valves 18*i* and 18*e* in a closing direction, respectively. The rocker arms 24*i* and 24*e* are disposed in a rocker chamber 26 defined between the cylinder head 9 and the head cover 10, and the tappets 22*i* and 22*e* and the push rods 23*i* and 23*e* are disposed in a rod chamber 27 defined below the cylinder block 7 and the cylinder head 9 in the direction of inclination of the cylinder block 7, i.e., in the lower sidewalls of the cylinder block 7 and the cylinder head 9.

Further, an auxiliary oil tank 28 is disposed below and sideways of the cylinder block 7 and the cylinder head 9. The auxiliary oil tank 28 is made of a synthetic resin and secured to the cylinder block 7 or the cylinder head 9 by a bolt 29, and has an inlet tube 28*a* fitted to an inner peripheral surface of a communication pipe 30 integrally provided on the sidewall of the oil pan 6 and protruding therefrom. A seal member 31 is interposed between the inlet tube 28*a* and the sidewall of the oil pan 6. Thus, the auxiliary oil tank 28 communicates with the inside of the oil pan 16, but in the usual service state of the engine, the auxiliary oil tank 28 is disposed above a specified level of the oil 16 stored in oil pan 6. The tank 28 has a volume sufficient to accommodate the oil stored in the oil pan 6.

An upper portion of the inside of the auxiliary tank 28 and an upper portion of the inside of the crankcase 5 communicate with each other through a vent pipe 32.

As shown in FIGS. 2 and 3, a breather pipe 33 permits the rocker chamber 26 to communicate with the inside of an air cleaner in an intake system (not shown).

The operation of this embodiment will be described below. If the engine 3 is driven to operate the rammer 1, the oil dipper 15 scoops and sprays oil 16 stored in the oil pan 6, with rotation of the crankshaft 11, thereby lubricating various portions of the crankshaft 11, the piston 13 and the valve operating device 20, with the sprayed oil.

The oil after lubricating the valve operating device 20, flows down into the rod chamber 27 provided in the lower sidewalls of the cylinder block 7 and the cylinder head 9, back to the inside of the oil pan 6. Therefore, the rod chamber 27 serves as a sprayed-oil admission passage and also as an oil return passage.

Figure 4:
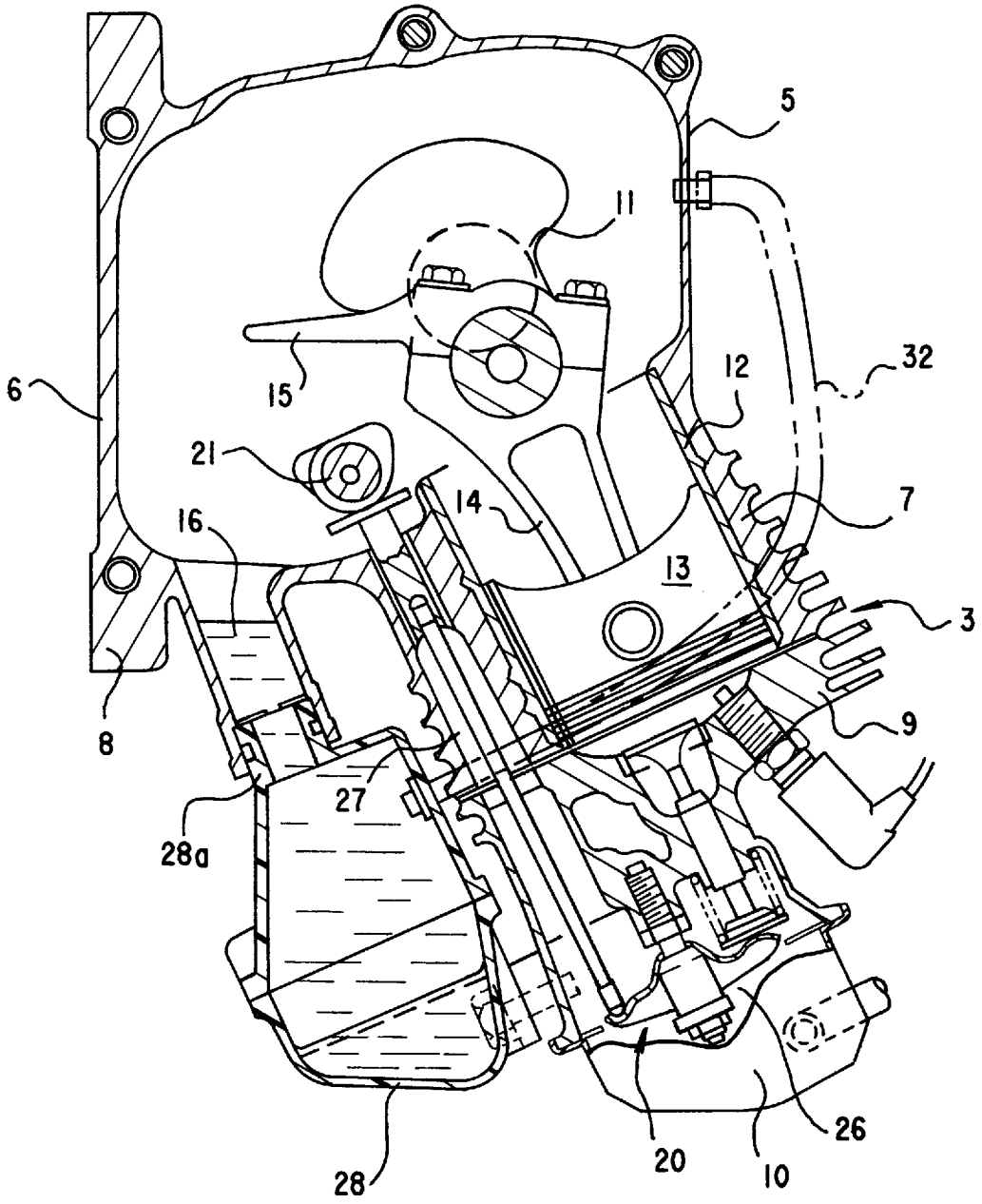
FIG. 4 is a view for explaining the operation of an auxiliary oil tank in the engine.

If the engine 3 is tilted in the direction of inclination of the cylinder block 7 as shown in FIG. 4 by laying down the rammer 1 sideways when the rammer 1 is stopped, the oil stored in the oil pan 6 tends to flow through the rod chamber 27 into the rocker chamber 26, or tends to flow into the cylinder 12. According to the present invention, however, the oil stored in the oil pan 6 flows through the communication pipe 30 into the auxiliary oil tank 28 and is collected in the auxiliary oil tank 28, because the auxiliary oil tank 28 is disposed below and to the side of the cylinder block 7 and the cylinder head 9. In this manner, the passage of oil 16 into the rod chamber 27 and the cylinder 12 can be prevented. In this case, as oil 16 flows into the auxiliary oil tank 28, air in the auxiliary oil tank 28 passes through the vent pipe 32 into the crankcase 5 and thus, the flow of the oil is not obstructed.

If the engine 3 is then righted into the usual service state shown in FIG. 1, all of the oil 16 is naturally returned from the auxiliary tank 28 into the oil pan 6.

The crankcase 5 and the cylinder block 6 formed separately may be coupled to each other by a bolt. In this case, the cylinder block 6 and the cylinder head 9 may be integrally formed.

Although the present invention has been described in detail, it will be understood that the present invention is not limited to the above-described embodiment, and various modifications in design may be made without departing from the spirit and scope of the invention defined in claims.

What is claimed is:

1. A 4-cycle engine comprising:

(a) a cylinder block;

(b) a crankcase fixed to said cylinder block, wherein said cylinder block is inclined with respect to said crankcase;

(c) an oil pan formed in the lower portion of said crankcase; and (d) an auxiliary oil tank mounted on one side of said cylinder block, and coupled to said oil pan such that oil in said oil pan flows from the oil pan into said auxiliary tank when said engine is tilted downward in the direction of inclination of said cylinder block.

2. A 4-cycle engine as set forth in claim 1, wherein said auxiliary oil tank is disposed below said cylinder block and wherein said engine includes a communication pipe disposed between said oil pan and said auxiliary oil tank, such that said auxiliary oil tank communicates with said oil pan through said communication pipe.

3. A 4-cycle engine as set forth in claim 2, further including a vent pipe extending between said crankcase and said auxiliary tank.

4. A 4-cycle engine as set forth in any of claims 1–3, further including:

(a) a rod chamber; and (b) a tappet and push rod valve operating device disposed in said rod chamber;

(c) wherein said rod chamber is disposed on a lower side wall of said cylinder block in the direction of inclination of said cylinder block.

* * * * *